US010527394B2

(12) United States Patent
Raquin

(10) Patent No.: US 10,527,394 B2
(45) Date of Patent: Jan. 7, 2020

(54) KINETIC AND/OR INCAPACITATING PROJECTILE HAVING HIGH ENERGY ABSORPTION

(71) Applicant: SECURINOV SA, Luxembourg (LU)

(72) Inventor: Cyrille Raquin, Sarras (FR)

(73) Assignee: SECURINOV SA, Luxembourg (LU)

( * ) Notice: Subject to any disclaimer, the term of this patent is extended or adjusted under 35 U.S.C. 154(b) by 0 days.

(21) Appl. No.: 15/579,662

(22) PCT Filed: May 31, 2016

(86) PCT No.: PCT/EP2016/062278
§ 371 (c)(1),
(2) Date: Dec. 5, 2017

(87) PCT Pub. No.: WO2016/193264
PCT Pub. Date: Dec. 8, 2016

(65) Prior Publication Data

US 2018/0156587 A1 Jun. 7, 2018

(30) Foreign Application Priority Data

Jun. 5, 2015 (LU) ..... 92734

(51) Int. Cl.
*F42B 12/34* (2006.01)
*F42B 12/74* (2006.01)
*F42B 12/78* (2006.01)

(52) U.S. Cl.
CPC ..... *F42B 12/34* (2013.01); *F42B 12/745* (2013.01); *F42B 12/78* (2013.01)

(58) Field of Classification Search
CPC ..... F42B 12/34; F42B 12/74; F42B 12/745; F42B 12/40; F42B 12/78
See application file for complete search history.

(56) References Cited

U.S. PATENT DOCUMENTS 3,680,485 A * 8/1972 Zaid ..... F42B 5/035 102/506
3,732,821 A * 5/1973 Royer ..... F42B 8/02 102/431

(Continued)

FOREIGN PATENT DOCUMENTS

FR 2930985 A1 11/2009
WO WO2009/141521 A1 11/2009

OTHER PUBLICATIONS

"Overview of materials for Thermoset Polyurethane Foam, Unreinforced ", www.matweb.com (Year: 2018).*

(Continued)

*Primary Examiner* — Joshua T Semick
(74) *Attorney, Agent, or Firm* — Muncy, Geissler, Olds & Lowe, PC

(57) ABSTRACT

The invention relates to a kinetic and/or incapacitating projectile having high energy absorption including: a body (1) made up of at least one portion made of cellular material, foam or open or closed microstructures; a head, made of a resilient polymer material; at least one layer (3) which makes it possible to link the assembly made up of the body (1), the head (2) and optionally a rear portion by annular constriction, said layer being made of a thin material, the thickness of which is less than five hundredths of the diameter of the projectile.

5 Claims, 1 Drawing Sheet

(56) References Cited

U.S. PATENT DOCUMENTS

| | | | | |
|---|---|---|---|---|
| 4,455,942 | A * | 6/1984 | Murray | F42B 8/02 102/444 |
| 5,505,137 | A * | 4/1996 | Godefroy | F42B 8/14 102/506 |
| 7,287,475 | B2 * | 10/2007 | Brunn | F42B 5/02 102/444 |
| 8,671,841 | B2 * | 3/2014 | Raquin | F42B 12/745 102/335 |
| 9,784,540 | B2 * | 10/2017 | Macy | F41A 9/65 |
| 2014/0109790 | A1 * | 4/2014 | Dannawi | F42B 8/12 102/502 |
| 2015/0018144 | A1 | 1/2015 | Chia | |

OTHER PUBLICATIONS

"Overview of materials for Polytetrafluoroethylene (PTFE), Glass Filled, Molded ", www.matweb.com (Year: 2018).*

* cited by examiner

KINETIC AND/OR INCAPACITATING PROJECTILE HAVING HIGH ENERGY ABSORPTION

FIELD OF THE INVENTION

The present invention relates generally to the field of less than lethal kinetic ammunitions utilized by law enforcement units and military forces in peace keeping missions and, more particularly, to kinetic and incapacitating projectiles especially suited for individual firearms or launchers of any kind of technology including gaz compression mostly for caliber between 9 mm and 56 mm.

BACKGROUND OF THE INVENTION

Launcher used in self defense are usually between 38 mm and 56 mm for law enforcement units or military forces and in some countries non lethal bullets are sold for public use in 12 gage caliber (around 19 mm), the penetration effect of such a projectile is generally greater for the smaller caliber at the same energy. In the state of the art the following patents are describing deformable or crushing heads with some controlled or limited force during impact FR 0802536, FR0900303 or WO2009FR00520 and the latest FR2950688. Said patent are describing realization of projectile using a head fastened to an holder which is resistant enough to engage the riffling and produce the rotation of the projectile in order to enhance the trajectory by gyroscopic effect. Those patent never describe the protection or confinement of the head, which should be smaller than the caliber to avoid friction and projectile deformation inside the barrel.

It is known from another patent of same inventor that the use of foam material or microstructure, especially of the polyphenolic or polycarbonate foam type used to get materials that absorb projectile energy with the projectile auto destruction by shearing of constitutive elements of the microstructure cells during the impact. It is also known by another said patent, that the use of foam material or microstructure of aluminium allows to get a progressive consumption during an impact by buckling of the alveoli walls or elements of the said foam or microstructure. These two types of structures to limit force to impact speeds and realize good attenuation of damage to the target but have advantages and disadvantages. The association of these two types of structures can be achieved in the present invention in order to make it more gradual and uniform on the impact area to reduce the maximum stress generated by the projectile on the target and seeking to increase the expansion of the impact with speed of the projectile. An industrial way to achieve that is to use a honeycomb open cells material type like a honeycomb with thin walls or an deployed aluminium structure which could be included in polymerized foam during manufacture.

The achievements of under calibrated projectiles for applications of hunting or military lethal are known as sold under trade marks like Sauvestre or FIER, these achievements are intended to bring greater speed of output, a flatter trajectory autorised by the structure of the projectile on trajectory after separation of the shells as for the Sauvestre bullet that is a civilian version of the so-called arrow and described in the patent FR19940012835 19941026 ammunition. The J P. Denis patent describes a mode of realization of a lethal munition under calibrated without separation on trajectory, which allows to get different behaviors of the ammunition in penetration on different types of materials or living bodies and also of strongly alter the aerodynamics and so the trajectory of the projectile and its kinematics. The shell used in this type of project is not fragile to the impact and may even play a role depending on the type of target encountered. It is on the achievements of aforementioned projectiles under calibrated in a way to produce lethal projectiles which is precisely the reverse of our goal: for lethal purposes, they need to reduce the projectile diameter to facilitate perforation or deeper penetration, reduced diameter also allows an improvement of the lengthening of the projectile and enhance its flight capacity for some specific applications.

Non-lethal projectile using a sliding jacket which allows a symmetrical launch without deformation of the projectile and which nevertheless fragile at impact in order not to modify terminal ballistics is new for the state of the art. Current achievements are describing a cylindrical body or head with an capacity of shock absorption and expansion. Most of such projectiles or head are constituted by foam material or alveolar structure with specific properties: fragile or breaking on impact; elastic or deformable way reversible or not. This front part is generally fixed or linked to a rear hard plastic part which is designed to take the riffling of the barrel, and essentially to support the thrust of the combustion gases during the shooting phase. The main aerodynamic default of those said low lethality projectile or claiming it, is the bad equilibrium in flight because the center of application of aerodynamic forces, is located in front of the centre of gravity of the projectile. Then the difficulty to balance it forward does not result from a misunderstanding of the man of the art in aerodynamics, but is related to the absence of a known design which could allows to realize it in an industrial way without generating disadvantages like the destruction or deformation of the shot during the launch or its immediate flight destabilization. In case of unsufficient stabilization by gyroscopic effect, most of the known projectiles have a strong tendency to destabilize on trajectory. Said unstabilization making the hard plastic holder coming forward to have a direct impact on the target with lethal effects or severe physiologic injuries. This defect is corrected according to the invention by the use of a rear soft tail nevertheless able to sustain the shooting burst and hot gazes, this tail can typically be made up of low density polyethylene, we can also use of the polyvinyl vinyl, or polyurethane containing the plasticizer or polyimide with a sufficient proportion of plasticizer to lower their point of glass transition below the temperatures specified for the use of the device according to the invention.

It is of great interest to develop for riffled barrels weapons a projectile which will not have a hard plastic holder to manage the launching pressure or to reduce this holding part to a simple cap in order at first to push forward the center of gravity of the projectile and improve its stable trajectory and on secondly to avoid the holder impact on target, which could occurs even with slight incidence. The main advantage according to the invention for rifled guns projectile is to get more than 60% of the projectile mass having both absorption and expansion capacities, where current projectiles actually have between 60 and 90% of the mass concentrated in a dangerous plastic part, said plastic holder could be lethal at impact for receiver if he is not protected by a helmet or a protection jacket. For smooth barreled launchers, there is an interest in developing a munition that retains the benefits of expansion to the impact such as the Bliniz, while providing the opportunity to realize stable path like an arrow and that enable smooth bore launcher to compete with rifle barrels law and order launchers.

Finally almost all projectiles marketed according to the State of the art are of restricted or prohibited usage below a certain distance due to the fact of their potential attrition if they went unstable on trajectory. So there is an interest in developing a precise and stable projectile for close range to long distance but whose softness and the force limitation at impact allows to use it from short distance; the best results will be obtained if one can also adapt the output speed of the Launcher depending on the distance of the target. The physical action of the projectile at impact according to the invention is to provide a strong deformation of the envelope that must be very soft and elastic, such soft material shows in compensation a very large coefficient of friction that is typically close to 80 or greater. With such material, contact between the soft head part and the barrel of the weapon will be asymmetrical and destructive. The projectile realization up to the inventor, allows to design a projectile very close in diameter with the caliber of the weapon and nevertheless, the contact surface with the launcher tube could shows very low friction coefficients and can especially be below 0.1 millimeter thick. Due to the fragile behavior of the jacket in dynamic conditions, it will break at impact and will not modify the terminal ballistic of the projectile head.

The realization of projectile which delivered limited force onto the target requires first of all to maintain the integrity of said projectile during the launch phase, on this aspect the present invention provides an answer since the sliding sheet (3) ensures the symmetrical gliding of the ogive in the launch tube and preserves its integrity of form until the impact while composition material is much more deformable and soft than the usual projectiles. One of the answers already given to the limitation of the lethality is to allow a strong expansion either by using elastic envelopes and contents in the form of particles, in particular like BeanBag and Bliniz described in the patent U.S. Pat. No. 6,302,028 or in the patent FR0900303 supra.

The projectiles described in these patents are not practically feasible without compromise between accuracy and low lethality; indeed, the search for the best spreading is going through the greatest possible elasticity and low hardness of the envelope or outer skin of said projectiles, such embodiments are caused to deform during the propulsion phase or even during the ballistic flight, such effects is known on the "Bliniz" which is able to provide heavy shock with limited penetration, but with a poor precision due to the aerodynamic flight deformation. The answer unveiled from the present invention makes possible not only to avoid the deformation of the projectile during the launching phase, but also to use simultaneously in the same projectile such microstructures and divided states of the material in a structure which will make possible in the same time, first not to be altered during the launching phase but also to ensure both the aerodynamic behavior and the limitation of the maximum force applied to the target by a better distribution of the stresses. The rigid foam providing a dynamically fragile structure of the core is quite complementary by nature with the fine divided particles inside an elastic content, because those particles are making during the impact a more important increase of the stress in the center of the impact and these are the radial components of the transmission of reaction this central impact to each of the grains that causes the spreading, presence of foam or soft elastic material in front of this divided particles bag will make a spreding in time of this centered impact energy.

Energy absorption in the present description is the dissipation of energy in a non-reversible destruction or deformation process; that is to say, when the applied force disappears, said deformation remains without any energy restitution effect, in fact this projectile structure achieve a quite perfect mechanical soft shock. At the contrary, the application of a force or the supply of mechanical energy during an impact on an elastomeric foam or elastic rubber projectile leads to a high compression which shows, at the end of the impact or application of the force, a mechanical restitution in the form of for example rebound, which is detrimental to the desired goal of delivering the energy of the projectile to the target.

If we take a conventional projectile, whose operational purpose is the law and order enforcement and which claims a mitigation of the lethality at the impact, as marketed or described in the existing patents, we always find a bouncing part of mechanically elastic, and especially at a significantly high speed, hence a potential threat while it rebound. The examination of the state of the art thus shows that two types of projectiles are available which are more or less lethal according to the energy and the zone of impact and marketed in the category of non-lethal kinetic projectiles according to the type of weapon in which they are fired.

First, it is known projectiles adapted to the rifled guns that are made with a rigid plastic holder or base which has the first function of taking the riffling or grooves of the barrel in order to ensure stabilization of said projectile by rotating and gyroscopic effect on its trajectory. Due to the hard plastic material used, this part must be of resilient material and little deformable to impact, such a projectile is therefore potentially very dangerous if it arrives on this rear part because of its low deformability and its low capacity to absorb a part of the energy of impact shock due to its physical modification (destruction, deformation, modification of molecular bonds).

Secondly, there are projectiles adapted to smooth-bore weapons which can be divided into two groups: the first group encompasses the stabilized projectiles; such stabilization could be made by a tail on their rear part. These elements are usually made of hard material and not very deformable, therefore, even if they are lighter and thinner than the holder or riffling ring of riffled weapons, they do not participate in the absorption effect nor spreading shock at impact; the second group is formed with short-range projectiles which claim a large area of impact. They are generally characterized by a bad aerodynamic form factor. In this category, we can put all known deformable projectiles with solid content or achieving a great deformation at impact like the "bean bags" or "Bliniz™" for example as well as the projectiles working in elastic compression at impact like that of the "flash ball" of the company "Verney Carron". It can thus be seen that the projectiles currently proposed are either potentially dangerous at impact or have aerodynamic characteristics which limit them to limited uses at short firing distances.

The known existing deformable projectiles have in addition a poor friction coefficients, typically higher than 0,5 on a metallic barrel, and at the same time make a projectile dissymmetry and slow down the departure if they came into contact with the gun. In particular this point is well established with a rubber envelope whose coefficient of friction on steel is known to be between 0.3 and 0.5 in static, and the friction coefficient that will be relevant for the dynamic launching phase is rather established around 0.8. We obtain then, that, if the deformation of the projectile is not perfectly symmetrical, which is almost the case, such projectile will be subject to a destabilizing force at the exit of gun, with a severe consequence on external ballistics by causing a tumbling, or nutation movement in the case of a projectile stabilized in rotation by gyroscopic effect. In order to avoid this contact, it is appealing according to the state of the art is a belt stripping grip for those driven in rotation or it is avoided that the deformable part of the head touches the core of the barrel for smooth-core launchers by reducing the diameter of the rubber or polymer head, which increases the level of stress per unit area applied to the impact area of the target.

For specific projectiles for smooth bore launchers, a sabot is then used to protect said projectile from the flames or burst of ignition, in order to collect the acceleration and facilitate its sliding, such embodiment is shown by "flash ball" projectile of Verney Carron company which uses an enveloping shoe Other deformable kinetic projectiles of 38 or 40 mm could also be found, using a fire-resistant holder or sabot equipped with a riffling ring for riffled weapons.

The operational need for a low lethality projectile that is easy to produce industrially can be reduced to the problem of having a highly deformable projectile during an impact and having a minimum of hard or harming parts, nevertheless designed so that it can withstand without modification its characteristics during the launching phase, and remains intact in shape and structure during the ballistic phases of flight, while being propelled with a minimum of friction during the launch phase. In order to be less harmful, the solutions are known and described in the state of the art since it is to use in contact with the target materials capable of large deformations or dispersion in an elastic content, the problem unresolved is how to succeed in preserving a form integrity to these soft or highly deformable composite assemblies, their deformation being according to random always dissymmetrical and thus degradating the ballistics. Such aim has to be withstand without enclosing said projectile in a hard shell. Solving problems concerning the symmetric sliding and reduced friction at the launching associated with the integrity of the projectile on trajectory are at first glance contradictory with the elastic deformation needed on target for a good terminal effect like those shown by soft and adherent projectiles.

SUMMARY OF THE INVENTION

Accordingly, it is an object of the present invention to provide a kinetic projectile that will deliver the same energy with a greater impact duration and onto a wider impact area on target using a softer material and escaping the need to have hard harmful plastic part to stabilize it.

Another object of the present invention is to provide a kinetic projectile that could be used without irreversible wound injury at short distance, down to less than 2 meters.

Other objects and advantages of the present invention will become more obvious hereinafter in the specification and drawing.

In accordance with the present invention, a non-lethal kinetic projectile of small or medium caliber is disclosed. The projectile incorporates an internal structure made principally with a low density rigid and dynamically fragile cellular material; an external hull or wall surrounding the said structure, made of a material with an extremely low hardness less than 20 shore A, or better less than 5 shore A and an elongation before rupture greater than 400%, said hull is balanced forward and produce a global balance of the gravity center forward the center of application of aerodynamical forces, said hull being thermocrimped on the structure by a third element which is a low friction coefficient material envelope. Such projectile is therefore globally a consistent projectile while nevertheless having a fragile behavior during the impact allowing a great expansion and energy transfert to the target.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
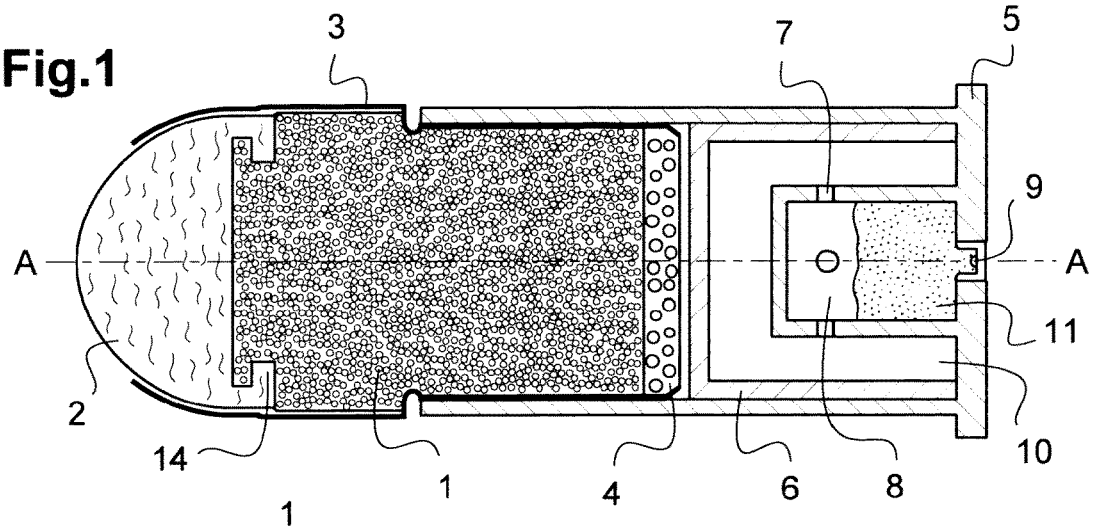
FIG. 1 is a cross-sectional view of a non-lethal projectile of the present invention for short range purpose dedicated to smooth bore launcher like 38 mm.

The present invention allow to maintain the external shape of the projectile due to the quasi static resistance of the internal structure (1) on which the elastic deformable hull (2) is thermocrimped by envelope (3), in some realization, said envelope is also crimping said hull (2) and tail (6*b*) together. This strong link between the external hull and internal structure is able to sustain the firing acceleration and the aerodynamic flight without noticeable shape deformation.

The present invention fulfill the following needs for a non lethal or controlled force delivery on target ammunition or projectile which simultaneously deform and expand when core crushes at impact without blessing parts:

The kinetic or incapacitating projectile unveiled by the inventor is intended for all defense launchers, whether their method of propulsion is pyrotechnic or by means of a compressed gas. The projectile can be composed of a multiplicity of parts essentially allowing to absorb the shock and which allows it to maintain good aerodynamic characteristics and stability on trajectory due to the invention.

Firstly, the projectile is capable of transferring a large part of the energy of the impact towards the target through said part or directly and to the final destination of said part by destruction, irreversible deformation, avoiding a penetration of the biological target. It does not include hard plastics or hard elastomers, in particular of hardness greater than 40 Shore A for any part. The lowering of the hardness and the increase of the elongation capacity at break making possible to prevent said wall from exhibiting harmful effect; Secondly, a projectile according to the invention retains good aerodynamic characteristics during launch and flight, which enable it to ensure satisfactory operational precision at distances similar to those obtained by kinetic projectiles propelled by riffled weapons even when launch with a smooth bore.

The present invention combines and integrates the following constituents in a kinetic projectile for small or medium caliber:

a projectile according to the invention is based on low density foam core (1) coupled with the use of a very soft head (2), characteristics coming from less than 30 shore A down to hardness of the elastic hull (2) less than 80 Shore00, and this despite the high coefficient of friction of the elastic and highly deformable material used for it, typically values of at least 0.35 for a friction on steel and which reaches a value of 0.7 or more in coefficient of friction on steel or aluminium, a characteristic necessary for the projectile to deform without ricocheting on the target even at high incidences, that is to say, impact trajectories, collinear with the axis of the projectile and having an incidence greater than 45° with the normal to the surface of said target.

The constriction applied by the outer layer or envelope (3) on the one hand and the inner core on the other hand on the soft, resilient and yet resilient material prevent it from being deformed in the weapon, thus allowing the launching of projectiles having an impact behavior such as that of gelatinous or viscous materials such as "splattball" for example; this ability to obtain repetitive trajectories due to the absence of deformation both in the weapon and on the trajectory of very soft and deformable projectiles at impact is the major characteristic for the industrial applications of said invention, whether for non-lethal projectiles used in policing with traditional launchers, but also for use in training ammunition or simulation or personal defense, especially with launchers using compressed gases.

Referring to FIG. 1, projectile uses a sabot (6*a*) which is independent from the projectile and/or to the head (2) and only able to ensure the air tightness during the launching phase.

Figure 2:
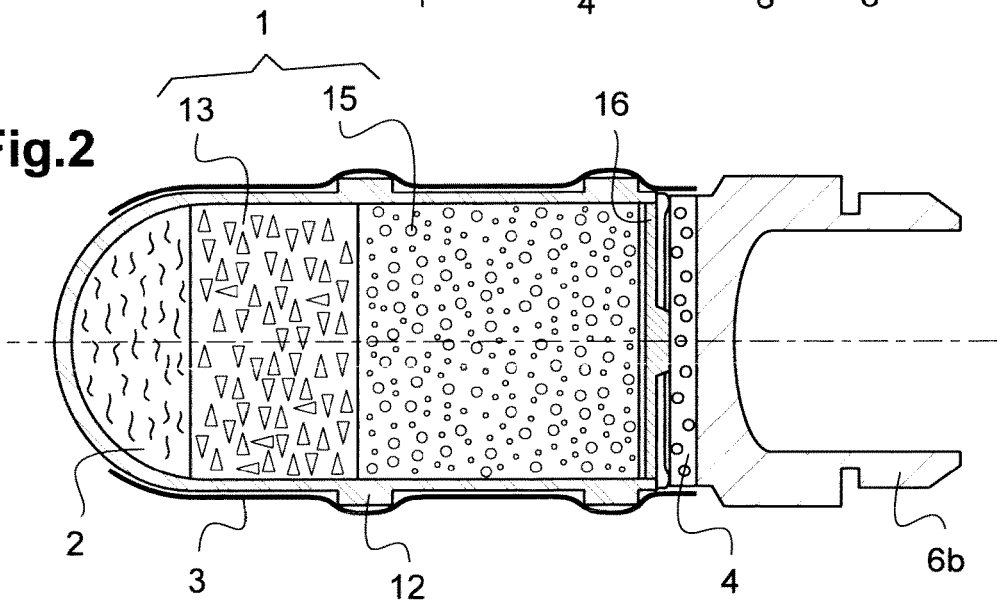
FIG. 2 is a cross-sectional view of a non-lethal projectile of the present invention for riffled launcher like 40 mm, and is equipped with a sabot or holder (6*b*).

Referring to FIG. 2, projectile uses a sabot (6*b*) which is linked to the projectile and/or to the head (2) and able to ensure ballistic flight and impact. This version is shown to be used in riffled weapon with the sabot (6*b*) able to drive the projectile in rotation during the launching phase.

Figure 3:
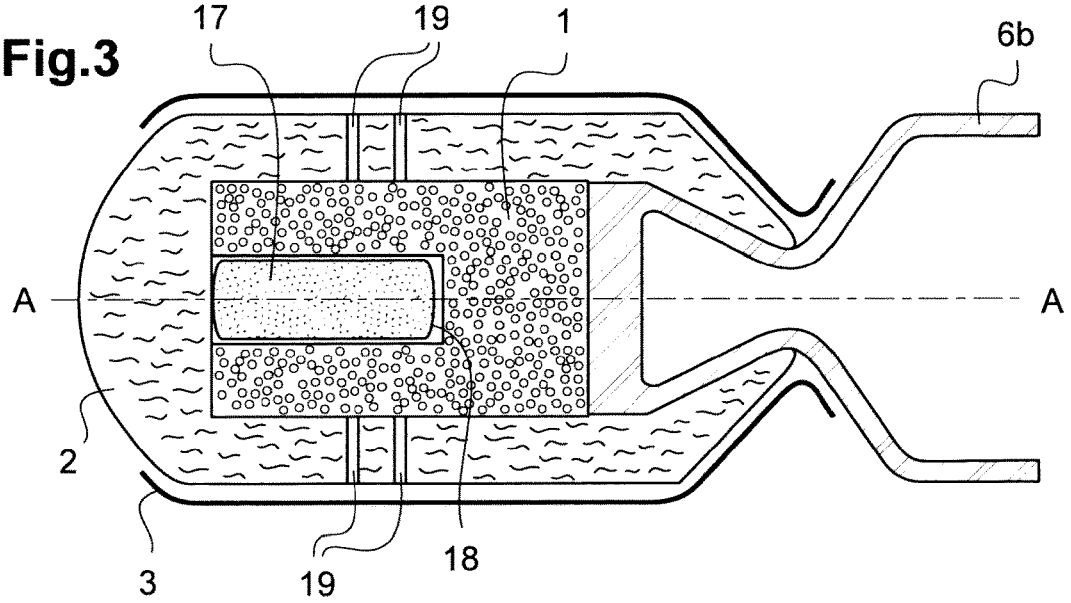
FIG. 3 is a cross-sectional view of a non-lethal projectile of the present invention for short to long range purpose dedicated to smooth bore launcher like 37-38, 44 or 56 mm.

Referring to FIG. 3, projectile uses a sabot (6*b*) which is linked to the projectile and/or to the head (2) by constriction and able to ensure ballistic flight and impact. This version is shown to be used in smooth bore weapon with the sabot (6*b*) made with soft deformable plastic unable to take riffling but well suited to sustain the ignition burst by reversible deformation.

The present figures are not a limitation to others executions or manufacturing that could be done upon the present invention, and especially to enhance the aspect without modifying his behavior during his life and his function. FIG. 1 is especially designed for existing smooth bore launchers, it is obvious that the invention could allow to design multi-projectiles systems or effectors, specifically non lethal that could be propelled by different means like pyrotechnic propulsion or gas under pressure. FIG. 2 is especially designed for riffled launchers like 40 mm and FIG. 3 is especially designed for both smooth bore launchers and compressed gaz launchers.

The projectile according to the invention consists of: a body said to be cylindrical or of revolution about the launching axis, formed of at least one homogeneous part made of cellular material, foam or open or closed microstructures having a capacity of absorption of energy in the sense defined in the description. For an usual embodiment, said portion will advantageously have a density of less than 250 Kg per cubic meter for absorbing energy in dynamic compression or shock which is effected either by first shearing the walls of the cells or elements constituting said structure, elongation at break being low for this type of material, or secondly by permanent or irreversible ductile deformation, in particular by buckling walls or thin surfaces like aluminium foam. It is possible to obtain homogeneous assemblies combining these two absorption properties, for example an open-cell aluminum cell microstructure or open-cell foam which is included in a polyphenol-based foam. Such embodiment having the advantage of the fact of the presence of aluminum or possibly magnesium to obtain a deformation behavior and therefore a force which decreases with the speed of deformation, so depending on the speed of impact while the rupture of a polyphenolic foam is sheared and remains almost independent of the impact velocity.

A head (2) or front part with a density greater than 500 $Kg/m^3$ made of an elastic polymer material, that optionally could be provided in a foam type, with an elongation limit greater than 100%, better if greater than 400%, showing a hardness less than 40 Shore A, but even better if it is softer is typically a shore hardness less than 80 Shore 00 and which has an elastic deformation capacity that is preserved in dynamics, this characteristic is often ignored by projectile builders who use rubber even though it is well known that the behavior of some kind of rubber can change into dynamics by becoming harder for higher deformation velocities; it is even known to toy children with rubber balls that bounce weakly at low height, but that beyond a certain speed of impact become so hard that they restore almost all their energy, thus allowing a very important rebound. For the embodiments of the head (2) according to the present invention, we have looked for soft but elastic shape memory materials whose characteristics persist at the usual impact speeds of about 100 meters per second. Said soft elastic material having a static coefficient of friction on metal, greater than 0.4 on polished stainless steel; the coefficient of adhesion, which is the coefficient measured on the moving parts, being higher and able to reach values of 0.7 or better, 0.8 on steel or aluminium and may be adapted according to the operational use made of it. In particular so as to allow the attainment of targets at a higher angle of incidence than the projectiles according to the state of the art for identical external forms. The friction measurement is a unitless value which is a ratio between tangential and normal surface components but whose minimum values are given on steel since they are known or measured for many materials in relation to these supports. which are the least adherent or the most slippery.

The combination of the cylindrical body core (1) of low density and this front portion (2) of density at least twice as large allows the projectile to have a center of gravity close to the front of the projectile which is obtained according to the invention without reducing ballistic nor spreading performance.

at least one outer envelope (3) or ply bonded by thermocrimping of the annular or radial constriction type which can be obtained in particular by a method of thermoforming an elastomer or heat-shrinkable plastic tube around the cylindrical body or core (1) and possibly around a part of the head (2) or cap covering the head to protect it from dust, therefore forming an assembly of revolution about the axis. Said thermocrimp ring consisting of any polymeric material or flexible film having a reduced coefficient of friction on the metals commonly used for launch tubes such as steel or aluminum, is typically less than 0.3 and a coefficient of friction as low as possible, typically 0.05 like for a PTFE ring or less than 0.1 for a lubricated polyvinyl chloride envelope (3), the latter compound having a price advantage and fragility at the longitudinal impact.

However, avoidance of the deformation of the projectile during its launch and in particular a symmetrical sliding with respect to the axis; the narrowing of the soft and elastic material on the internal honeycomb structure surprisingly producing a projectile hard to the touch, which has a moderate and symmetrical friction given its low coefficient of adhesion on the metal in the launch tube, but which becomes very soft on impact. Materials meeting the characteristics required for achieving a state-of-the-art embodiment are well known for various industrial applications such as cladding and insulation of electrical conductors; these include products based on polyolefin, polyvinyl chloride or polytetrafluoroethylene, polyfluoro vinylidene products which will be preferred for the fabrications according to the present invention because of their coefficient of friction and their behavioral stability in temperature. Said head may be linked to the cylindrical body by this simple force of constriction of the sheet or ring (3); it will be possible for a better holding, in particular during the manufacture or implementation of the projectile making a stronger bond, especially by bonding or taking into account the elasticity of the material constituting said head to grip a portion of the cylindrical body, for example in a throat made for this purpose in the body. The outer ply is conventionally obtained from a single tube, preferably by necking thermocrimping, made of a material such that this ply is fragile and/or brittle at the expected impact speed, which can separate the PTFE as a choice. possible if the spreading requirements are high.

According to an improvement of an embodiment of the invention, said outer ply (3) is obtained from a single tube implemented by thermocrimping in order to obtain a necking of uniform revolution of the elements situated inside, it can be act of the cylindrical body, but also other elements such as the head (2) and the damping washer (6*a*) or sabot (6*b*) located at the back or any other part that should be placed inside, for example to smooth irregularities or create radial elasticity to ensure better guidance. According to the invention, it is advantageous if said outer ply (3) is made fragile and/or brittle for the expected impact speed, which ensures that this part will not come to limit the expansion of said projectile, on the other hand if thickness, by example less than 0.5 millimeter and its weight are limited, the chips will not be harmful during the impact.

According to a preferred embodiment of the invention, the cylindrical body is inserted in a casing made of elastic material with a high elongation at break of more than 100% or more preferably of more than 400% forming a cavity and having a thin sidewall thickness relative very small to its diameter. Preferably, the thickness of the side wall of the cavity thickness is less than 10%, preferably less than 5% of its total diameter. Said elastic envelope itself remaining crimped by the outer ply (3). Said elastic material is preferably a shock or vibration energy absorber, in particular thermoplastic elastomers such as polyurethane and polyether copolymers, block polystyrene or such as those marketed under the "Sorbothane" brand, the molecular bonds of which are modified by impact energy and which for some of them partially restore this energy in the form of heat. It may also be a layer of thin thickness similar to that of a balloon, for example latex or rubber with high elongation at break. This result can in particular be obtained by dipping in a polymer resin with a high proportion of plasticizer before crosslinking or in a bath of natural or synthetic rubber before vulcanization. Very soft and elastic compounds can also be obtained by diluting thermoplastic in at least one plasticizer. Said elastic material is preferably very elastic and a shock or vibration energy absorber, said envelope not having the purpose of obtaining a rebound or a spring effect by buckling of said envelope at the moment of impact, but on the contrary a maximum spread of the impact while preserving the overall externality of the projectile as a whole. This envelope (3) is not necessarily waterproof, but a sealed embodiment has the advantage of confining the destruction residues of the constituent material of the cylindrical body during the impact. This improvement of the present invention can also be considered as an improvement of the same author's invention as published by the USPTO under U.S. Pat. No. 8,671,841B2, the main defect of an embodiment according to this prior invention being the difficulty of achieving a bonding or necking of the envelope alone which makes possible contact with the tube during the launch, the realization of the projectile requiring a margin of safety between the diameter of the ogive and the diameter of the tube to avoid friction. The present invention makes it possible to produce projectiles as defined in the original patent but with a diameter allowing a symmetrical friction and very attenuated with the barrel, which avoids asymmetric deformations detrimental to the proper functioning or accuracy.

According to a preferred embodiment of the inventor, the body comprises at least one part made of a cellular material or resilient microstructure having a density of less than 300 kg per cubic meter and whose energy absorption in dynamic compression is effected by continuous deformation or buckling of the cell walls or constituent elements of said structure. These include aluminum foam, magnesium or one of their alloys. The energy absorption here is different and also has characteristics that are different depending on the impact speed of this part. Depending on the usual speed during the impact and the deceleration produced by the front part which precedes this part, the length of the front part will be calculated so that the effective strain rate of this part more resilient is characterized its threshold of deformation. For aluminum foams or alloys with a high aluminum content, the compressive strength characteristic decreases with the speed at the moment of contact. According to a more ecological embodiment, the body can be made from biodegradable organic materials such as albumin, sugars or starch used to form after manufacture a hard foam of the density adapted to the density and performance obtained in axial compression.

According to another preferred version of the inventor, the body of the projectile comprises at least one container filled with a finely divided solid: that is to say particles of larger outer dimension less than 0.3 mm. During the impact, this envelope will rupture by brittle fracture and the transfer of energy in radial velocity of said particles will produce a large spreading. Placed behind a part acting by braking or energy absorption by rupture or deformation, one thus obtains a projectile which at the same time limits the force applied and particularly limits the stress in the central part, which is the problem existing in projectiles like BEANBAG or BLINIZ; while maintaining a spreading power equivalent to these same projectiles. In addition, the embodiment according to the invention makes it possible to obtain a projectile which retains its integrity and its initial shape until the impact and therefore allows a much better accuracy and a greater range than the commercial projectiles mentioned above. This improvement can be considered as an improvement of patent U.S. Pat. No. 6,302,028B1 Richard Guillot inventor of "Bliniz".

According to an improvement of the embodiment according to the invention, the projectile also has a ring or torus, possibly put in place by constriction due to thermoforming to ensure the sliding and centering of the front of the projectile by friction on the bore of the launch tube; and also in the tubes having scratches to ensure the rotation of the projectile. This torus may be made of a thermo-formable material with a low coefficient of friction, such as for example a polytetrafluoroethylene ring, which ring may also grip a thinner sheet which covers the rear part. Another embodiment would be to resort to a multiplicity of rings that enclose the projectile so that when leaving the blow the adherent walls of the head or the envelope do not come into contact with the launch tube. These rings are intended to ensure only a slip during launch but must remain low mass (typically less than one gram) so that their effect is negligible at the time of impact. This type of ring can also perform other functions including, in particular, the attachment of a sheet on the body, or an envelope on the body or the striker grip for the rotational drive of the projectile.

In the schematic representation of the figures describing embodiments according to the invention, the foam is represented by an assembly containing cells symbolized by circles (hard polymer foam), or triangles for aluminum microstructures aiming to absorb the compression energy by irreversible deformation of the walls or wires that constitute it. The density is symbolized by the number of cells per unit area; the cells represented symbolizing trapped air, the higher the number of symbols per unit area, the lower the density. The representations are neither faithful nor limiting but intended to facilitate the understanding of the achievements described by way of example.

With this combined parts the invention obtain:

A progressive deceleration that enable the surface spreading of the energy and ensure a total movement quantities transfer to the target while allowing to launch smooth projectile without disrupting them during launching and ballistic phases. At impact, the visco-elastic deformation of the external wall or hull is greater than in other projectiles by the use of highly elastic and deformable low shore 00 polymers. A duration extended at impact by fragile rupture of the small elements or cells constituting the inside rigid structure that crushes at impact combined with the low shore polymer ensure total disruption at impact and near to full movement quantity transfer, avoiding harmful effects in the target.

Manners to realize projectiles up to the invention are described here after, as simple non limitative examples, and with a reference to drawing annexed as FIG. 1 to FIG. 3.

FIG. 1 shows a section of the munition made using a projectile according to the invention, the cylindrical core (1) is here made of hard polymer foam, for example polyphenol with a density of 130 Kg/m$^3$. On the front part is embedded a semi-ellipsoid or hemispherical shaped head which is connected to the body by a groove 14 which corresponds to a lip of the head 2, the elasticity of the material of the head (2) and the tight ribs allow a good connection reinforced by the necking of the thermocrimped envelope (3) and which can be reinforced if necessary by a bonding between the head (2) and the core or body (1), nevertheless the gluing is industrially difficult to implement, given the materials which are hardly compatible for a single-component gluing. The launching axis A projectile is the same for the outer layer 3, the head 2 and the body 1 of the projectile when it is assembled and ready for launch. In the present embodiment, the sheet of heat-shrinkable polymer (3) covers and binds to the body (1) by necking, a damping disc (4) constituted in this example of polyphenol foam density 70 Kg/m$^3$; it will of course be necessary to adjust the respective densities of the body (1) and the disc (4) in particular as a function of the desired speed, the propulsive charge used, the mass of the head (2) and the length of the launching barrel, all these parameters being of course dependent on laws and know-how in the state of the art. There is shown here an ammunition using a shell (5) which can be made of metal and/or polymer and is equipped with high pressure chamber (8) and low pressure chambers (10) linked by regulating vents (7) between them. During the initiation of the primer (9), the propellant powder (11) generates a rise in pressure in the high pressure chamber (8), the vents then regulate the pressure and expansion of the hot gases in the low pressure chamber (10), the expandable jacket or tail (6*b*) is then subjected to an increasing force that is transmitted to the projectile. The increase in intensity of this force is softened by the progressive destruction of a large part of the foam of the disk 4 and the reversible deformation or expansion of the tail (6*b*) cavity, which makes it possible to speed up the head (2) and the body (1) of the projectile, which slide in the launching tube by a friction between the external crimping envelope (3) and the wall of the barrel. A projectile for a compressed air launcher may be identical to this embodiment by replacing the damping disc (4) by a thin chip to prevent damage to the foam of the body during handling, especially at the time of loading.

FIG. 2 represents an embodiment according to the invention that can be adapted to a rifled barrel weapon because of the presence of a holder or sabot (6*b*) able to drive the projectile in rotation when accelerating in the bore. The operation of the use of such weapons is not significant by respecting an embodiment according to the invention, there is a commercial interest in making such projectiles compatible with such launchers and their ammunition. The cylindrical part here consists of two parts, the first foam placed at the front is formed of aluminum foam (13), whose breaking characteristics and particularly the reaction force applied to the target by the projectile during the impact varies to the inverse of the impact speed for high impact speeds and in particular greater than 50 m/s; it is placed behind a honeycomb structure (15) based on thermosetting polymer of low elongation at break, typically less than 5% and capable of withstanding the acceleration of the shot without being significantly destroyed in its length. Such a foam will be chosen between polycarbonate, polyphenols or polymetracylimides for densities generally less than 150 Kg/m$^3$. The defect of the two structures presented is, during the initial target projectile contact, to generate a fast rising edge of said reaction force, which corresponds medically to the risk of fracture of the impacted bones. The introduction on the front part of the elastic foam head (2) with a density of less than 500 kg/m3 makes it possible to obtain a gradual increase in load and a beginning of spreading or increase of the contact surface before obtaining a nominal or maximum force; these values being obtained by this configuration only when the diameter has increased significantly is typically more than 25%. Given the respective densities of the materials used, the projectile is then balanced forward and can then be used indifferently in launcher rifled or not. For a better effectiveness during the impact and in order to avoid the allergenic effects of the particles released by the fragmentation of the core (1), it is possible according to the inventors to carry out a dipping of the assembly thus constituted according to FIG. 2 in a liquid which can then crosslink or vulcanize to form a tight layer (12) of the flexible envelope or balloon type, it can also be made in a material similar to that of the head (2) in order to obtain a good connection on the front part between the head (2) and the envelope (3). This layer is preferably elastic like silicone or low hardness rubber. It may be useful to use a cap (16) which will take as little thickness as possible to ensure a good distribution of the pressure on the part (15) or body (1) and a good bonding or a good bond with the layer or elastic envelope (3). An outer ply (3) surrounds all the subassemblies by a thermoforming operation and ensures the guidance of the projectile and its sliding without participating in its rotation in the context of its use with a launcher rifled barrel.

FIG. 3 shows a projectile for smooth launch tube, whether compressed air or a firearm. The front part (2) extended laterally to form a hull here covers the body (1) which accommodates a hard and fragile container (18) and its content (17) consisting of finely divided particles. Said content (17) may have a spreading action of the projectile only inertial impact since under the effect of the impact the particles convert to a large extent their axial momentum in radial momentum, but can also produce a incapacitative action on target if the constituent particles have at least on the surface of active chemical compounds such as tear gas and that are provided lateral holes (19) through the hull (2), being noted in the previous description. The hull (2) comes here exert a cohesive force by simultaneous annular tightening of the body (1) and the rear part (6*b*) mainly used during manipulation and manufacture process, this cohesion is then reinforced by the tightening provided by the external enveloppe (3) which comes press and compress the material of the hull (2) against the body (1). It should be noted in this embodiment according to the invention that the aerodynamic external shape can be modulated according to the performance constraints imposed either by the mass of the percussive part before or by the range or precision required at a certain distance. It will then be important to determine by calculation and aerodynamic simulation according to the state of the art the outer shape of the rear portion (6*b*) and the length of the front portion up to the projectile caliber. In particular, with regard to the lesional aspects, the volume of the body 1 and its density determine the energy that can be absorbed on impact, in particular that which drives the rear part (6).

The contents (17) may in particular be a liquid, a gel, a powder or a finely divided solid, taken separately or in combination. This content is chosen for its ability to disperse after the impact and light enough to remain suspended in the air because of the turbulence induced by this dispersion.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A non-lethal kinetic projectile of small or medium caliber, comprising:

at least an internal structure made principally with a material having a density lower than 250 kg/m$^3$ including foam material including open or closed microstructure(s) which shears at impact to achieve energy absorption;

a front part, principally made of elastic polymer material having a limit on elongation greater than 400%, a density greater than 500 Kg/m$^3$ and a hardness less than 80 Shore 00;

at least one envelope, said at least one envelope having a total thickness of less than 0.5 millimeters;

the at least one envelope is made of thermocrimping material to have a low coefficient of friction with respect to steel or aluminum of less than 0.3, wherein the internal structure and the front part are bound together by thermocrimping the at least one envelope around the internal structure and the front part; wherein the thermocrimped envelope is capable of sliding in a bore of a barrel, sustaining launching stresses and fracturing upon an impact with a target;

a thrust collecting rear part, coupled with the internal structure and having a hardness less than 40 shore A and able to sustain the ignition burst of the launch phase by reversible deformation.

2. The projectile of claim 1, wherein the rear part is bound together with the internal structure and the front part by thermocrimping the envelope around at least a portion of each of the front part, the internal structure and the rear part.

3. The projectile of claim 1, wherein the at least one envelope is made of a polyvinyl chloride tube that has been processed to be thermocrimped to fasten the rear part, the internal structure and the front part together.

4. The projectile of claim 1, wherein the internal structure is recessed at a center of the internal structure symmetrically about an axis in order to include a chamber filled with a powder material or filled with finely divided solids contained in the chamber, said chamber designed to be fragile and fracture during impact at a speed on a ballistic flight but not during an accidental fall or acceleration in the bore where intensity of the acceleration is softened by a progressive almost complete destruction of a foam of a disk between the rear part and the internal structure and the reversible elastic deformation or expansion of rear cavity formed by a tail on the rear part.

5. The projectile according to claim 1, wherein the internal structure is recessed at a center of the internal structure symmetrically about an axis in order to include at least one bag containing a product, said bag dimensioned to break by brittle fracture upon impact, said product being selected from the group consisting of a liquid, a gel, a powder, and finely divided solid particles, the product having active chemical compounds including tear gas which is configured to be delivered to the target through holes in the front part.

* * * * *